United States Patent [19]

Imura et al.

[11] Patent Number: 4,476,152

[45] Date of Patent: Oct. 9, 1984

[54] METHOD FOR PRODUCTION OF MAGNETIC BUBBLE MEMORY DEVICE

[75] Inventors: Ryo Imura, Sayama; Tadashi Ikeda, Kodaira; Norio Ohta, Sayama; Teruaki Takeuchi, Kokubunji; Yutaka Sugita, Tokorozawa, all of Japan

[73] Assignee: Hitachi, Ltd., Tokyo, Japan

[21] Appl. No.: 465,298

[22] Filed: Feb. 9, 1983

[30] Foreign Application Priority Data

Feb. 19, 1982 [JP] Japan ..... 57-24350

[51] Int. Cl.[3] ..... B05D 3/06

[52] U.S. Cl. ..... 427/38; 365/36; 250/492.3; 427/130

[58] Field of Search ..... 427/38, 39, 130; 250/492.3; 365/36

[56] References Cited

PUBLICATIONS

Wolfe et al, "The Bell System Tech. Jour.", (Jul.-Aug.-1972), pp. 1436-1440.

Ahn et al, "IEEE Trans. of Magnetics", vol. Mag-16, No. 1, (Jan. 1980), pp. 93-98.

Ju et al, "IBM J. Res. Develop.", vol. 25, No. 4, Jul. 1981, pp. 295-302.

*Primary Examiner*—John H. Newsome

*Attorney, Agent, or Firm*—Antonelli, Terry & Wands

[57] ABSTRACT

Hydrogen ion is implanted twice or more at different acceleration voltages into desired portions of a magnetic film holding magnetic bubbles to form a magnetic bubble propagation path. This ensures production of an ion-implanted device having a sufficiently large anisotropic magnetic field parallel to the magnetic film and a high Curie temperature.

13 Claims, 10 Drawing Figures

METHOD FOR PRODUCTION OF MAGNETIC BUBBLE MEMORY DEVICE

BACKGROUND OF THE INVENTION

1. Field of the Invention

This invention relates to a method for production of a magnetic bubble memory device, especially, of the type provided with magnetic bubble propagation circuit formed by ion implantation. Such a device will be termed an ion-implanted device hereinafter.

2. Description of the Prior Art

As well known in the art, it has hitherto been general practice to use a magnetic bubble memory device with permalloy-film magnetic bubble propagation circuit, that is to say, a so-called permalloy device.

Particularly, in the permalloy device, a permalloy (soft magnetic substance) film 1 having a planar pattern, for example, as shown in FIG. 1 is provided on a magnetic bubble holding film (not shown) of, for example, magnetic garnet $(YSmLuCa)_3(FeGe)_5O_{12}$ to form magnetic bubble propagation circuit, and a rotating magnetic field is applied parallel to the garnet film to propagate a magnetic bubble 2.

The permalloy pattern (permalloy film) 1 and a conductor pattern 5 of, for example, an Al-Cu or Au film formed between a magnetic garnet film 3 and the permalloy pattern 1 through insulating films 4 and 6, as shown in partial sectional form in FIG. 2, constitute a bubble generator, a transfer gate, a swap gate or a replicator adapted to generate, transfer, swap or replicate magnetic bubbles. When a control pulse current is passed through the conductor pattern 5, various functions such as generation of the magnetic bubble and transfer thereof are carried out.

Typically, the magnetic garnet film 3 for holding the magnetic bubbles is formed through liquid phase epitaxial growth process on a (111) oriented surface of a non-magnetic single crystalline substrate of, for example, $Gd_3Ga_5O_{12}$. The non-magnetic substrate, however, is not directly related to the present invention and is not depicted in FIG. 2 to avoid prolixity of illustration.

With the progress of high-density and highly integrated formation of the magnetic bubble device, highly fine patterning of the permalloy propagation circuit has been employed wherein the width and gap of the permalloy pattern are considerably reduced. For example, in order to form a device of a bit period of 8 μm using the magnetic bubble having a diameter of about 2 μm, the permalloy pattern is required to have a width and a gap of about 1 μm.

Moreover, materialization of a future permalloy device which is further advanced in density will require the accurate formation of a fine pattern of less than 1 μm width and gap over the entire chip. Existing technique is, however, difficult to meet such a requirement.

To cope with this problem, a new type of magnetic bubble memory device has recently been proposed as disclosed in U.S. Pat. No. 3,828,329 and it has been highlighted.

This type of magnetic bubble memory device advantageously substitutes a propagation circuit formed by ion implantation for the conventional propagation circuit made of a film of soft magnetic substance such as permalloy, and it is called an ion-implanted device.

More particularly, as schematically shown in FIG. 3, a mask in the form of a contiguous disc (not shown) is applied to cover a desired portion of the magnetic garnet film 3 and various ions such as for example $H^+$, $H_2^+$, $D_2^+$, $He^+$ and $Ne^+$ are implanted into exposed portions of the magnetic garnet film to form ion-implanted regions 7 outside the mask so that magnetization in the regions 7 directs parallel to the film plane.

When a rotating magnetic field is applied parallel to the magnetic garnet film having the ion-implanted regions, the magnetic bubble is propagated along the edge of a contiguous-disc region (propagation circuit) 16 as will be done along the permalloy pattern in the conventional device.

With the ion-implanted device, the propagation circuit 16 can advantageously have a pattern size which is about twice as large as that of the permalloy pattern for obtaining the same bit density. This ensures that the ion-implanted device can be easy to produce and can be highly suitable for high-density formation.

The ion-implanted device makes use of properties of a magnetized layer parallel to the magnetic garnet film which is set up on account of magnetostrictive effect due to ion implantation. In particular, as shown in FIG. 4, greater ion implantation effect can be obtained by ion implantation with hydrogen ion than by ion implantation with other ions, and an anisotropic magnetic field $\Delta Hk$ parallel to the magnetic garnet film can be increased by increasing the ion dose.

For the sake of obtaining a desired amount of magnetostriction, the ion implantation with hydrogen ion is disadvantageous because the small mass of hydrogen ion requires the ion dose to be increased considerably and because hydrogen ion liable to volatilize at high temperatures makes characteristics unstable when heat treatment is effected after the ion implantation.

For these reasons, a method of multiple ion implantation has been proposed wherein hydrogen ion is combined with thermally stable ions such as $Ne^+$ and $He^+$.

A magnetic garnet film prepared by this method, however, suffers from a low Curie temperature and has difficulties for practical use. Thus, the advent of a solution to the above problems has been desired strongly.

SUMMARY OF THE INVENTION

The present invention contemplates elimination of the above conventional drawbacks and has for its object to provide a method for production of an ion-implanted magnetic bubble memory device having a sufficiently high Curie temperature Tc which is suitable for high-density and highly integrated formation.

To accomplish the above object, according to the invention, an ion-implanted magnetic bubble memory device can be produced by multiple-implanting hydrogen ions into surface regions of a magnetic film of the device holding magnetic bubbles to form magnetostrictive layers which can prevent reduction in the Curie temperature Tc to provide a sufficiently large operational margin.

DESCRIPTION OF THE PREFERRED EMBODIMENTS

An ion-implanted magnetic garnet film prepared by multiple-implanting hydrogen ion, $Ne^+$ and $He^+$ in combination disadvantageously suffers from a low Curie temperature, as described previously.

Figure 1:
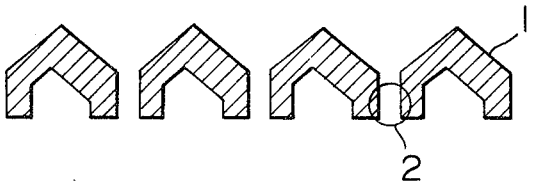
FIG. 1 PRIOR ART
FIG. 1 shows a planar configuration of a prior art permalloy pattern.
Figure 2:
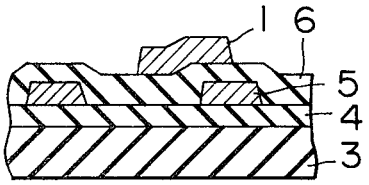
FIG. 2 PRIOR ART
FIG. 2 is a fragmentary sectional view showing a prior art permalloy device.
Figure 3:
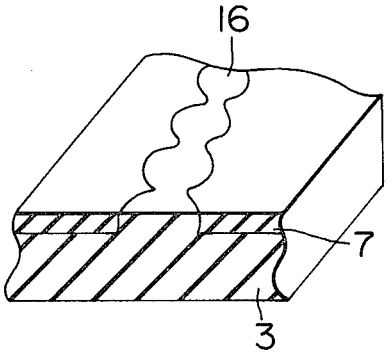
FIG. 3 is a fragmentary perspective view, partly sectioned, of an ion-implanted device useful in explaining a magnetic bubble propagation path.
Figure 4:
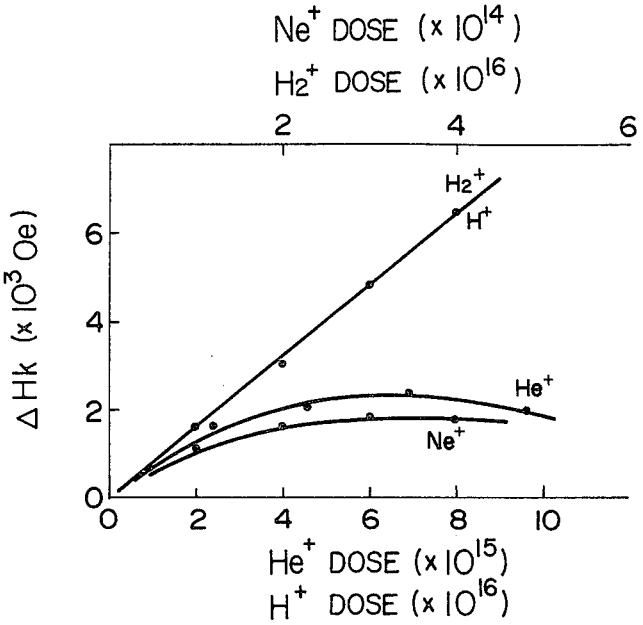
FIG. 4 is a graph showing the relation between ion dose and anisotropic magnetic field $\Delta Hk$.
Figure 5:
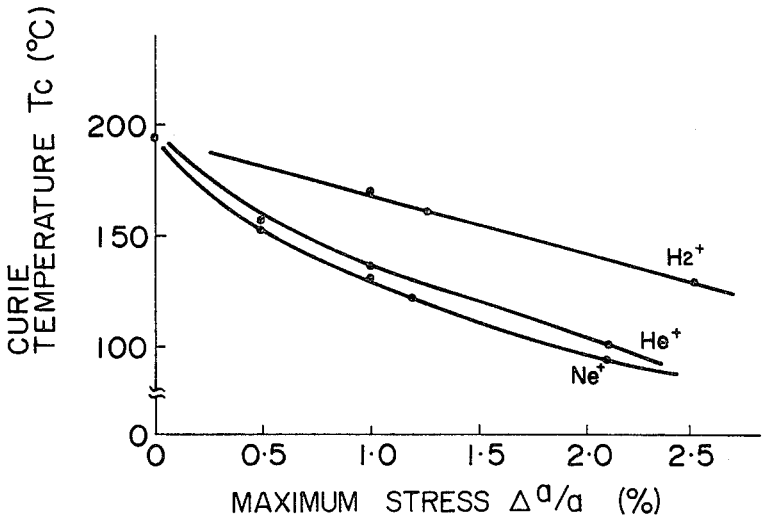
FIG. 5 is a graph showing the relation between magnetostriction obtained by ion implantation and Curie temperature Tc.

More particularly, as shown in FIG. 5, the ion-implanted layer has a Curie temperature Tc which reduces as the ion dose increases and the reduction is aggravated in proportion to the mass of implantated ions. Specifically, it has been proven that the Curie temperature Tc of an ion-implanted device produced by multiple-implanting a plurality of kinds of ions in combination depends on a Curie temperature of a layer into which the heaviest ion is implanted. Therefore, when multiple-implanting hydrogen ion in combination with $Ne^+$ or $He^+$, then Curie temperature Tc is determined by implanted $Ne^+$ or $He^+$ and reduced accordingly. Since a stress caused by ion implantation is proportional to the ion dose, the abscissa in FIG. 5 is represented by the maximum value Δa/a (a: lattice constant) of the stress.

From the standpoint of the operational temperature range of a practical ion-implanted device, the reduction in Curie temperature Tc due to $Ne^+$ or $He^+$ imposes a fatal problem on practical use of the device.

The present invention solves the above problem by multiple implantation with hydrogen ions alone and will be described in greater detail by referring to preferred embodiments.

EMBODIMENT 1

Figure 6:
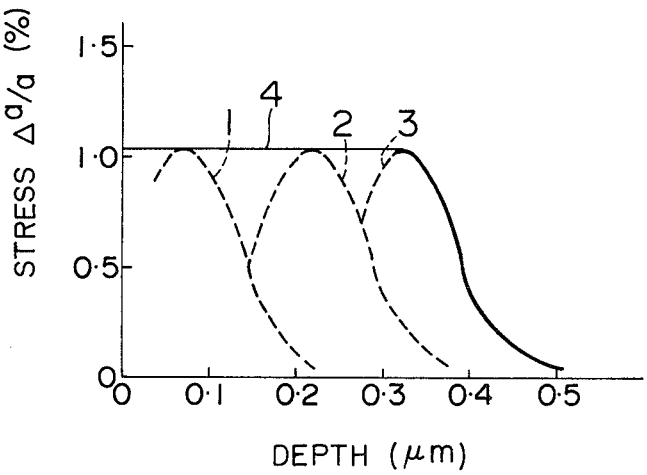
FIG. 6 is a graph showing the relation between the depth of ion implantation and magnetostriction.

FIG. 6 shows a stress in a magnetic garnet film which is caused by triple-implanting $H_2^+$ at an ion dose of $1\times10^{16}$ ion/cm$^2$, $H^+$ at an ion dose of $4\times10^{16}$ ion/cm$^2$ and $H^+$ at an ion dose of $8\times10^{16}$ ion/cm$^2$ in combination. For simplicity of description, the implantations of $H_2^+$ and $H^+$ at the ion doses as above will hereinafter be referred to as $H_2^+$/1E16, $H^+$/4E16 and $H^+$/8E16 ion implantations, respectively. When ion implantations at $H_2^+$/1E16 at 25 KeV, $H^+$/4E16 at 30 KeV and $H^+$/8E16 at 50 KeV are independently carried out, stress distributions as represented by curves 1, 2 and 3 in FIG. 6 are obtained. But when a triple ion implantation is carried out under the same condition, the curves 1, 2 and 3 are added to each other to exhibit a distribution as represented by curve 4. Thus, while $H_2^+$/1E16, $H^+$/4E16 and $H^+$/8E16 ion implantations will be carried out independently to provide Curie temperatures of 180° C., 170° C. and 160° C., respectively, it has been proven that according to this embodiment, the triple ion-implanted magnetic garnet film has a Curie temperature Tc of about 160° C. which is determined by the $H^+$/8E16 ion implantation. On the other hand, it will be appreciated that a prior art ion-implanted device prepared by triple-implanting $Ne^+$ and hydrogen ion in combination, that is, by effecting $Ne^+$/1E14, $Ne^+$/2E14 and $H_2^+$/2E16 ion implantations in combination will have a Curie temperature Tc of about 120° C. which depends on the $Ne^+$/2E14 ion implantation. In comparison, the ion-implanted magnetic bubble memory device according to the present invention prepared by triple-implanting hydrogen ions alone has proven to exhibit a Curie temperature which is 40° C. higher than that of the prior art ion-implanted device prepared by triple ion implantation with $Ne^+$ and hydrogen ion, thus providing superior characteristics for practical purposes.

Further, in production of the magnetic bubble device by multiple implantation with hydrogen ions alone according to this invention, hydrogen in the form of molecular gas is used so that monoatomic ion ($H^+$) and molecular ion ($H_2^+$) are created during ion implantation. Accordingly, through one implantation process, a multiple ion implantation with molecular ion and monoatomic ion can be accomplished by periodically changing mass analyzing current in a mass analyzer of an ion implantation device. Consequently, the uniform stress distribution as shown in FIG. 6 required for obtaining an excellent magnetized layer parallel to the magnetic garnet film can readily be obtained.

EMBODIMENT 2

Figure 7:
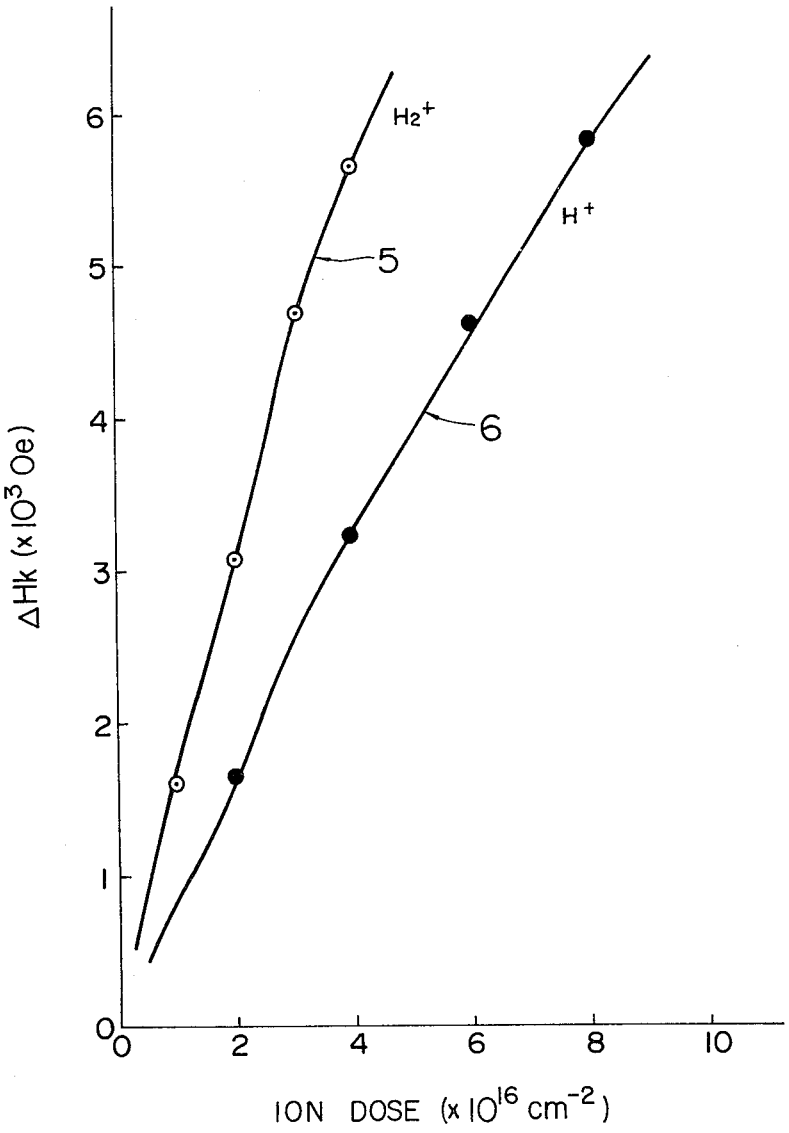
FIG. 7 is a graph showing the relation between ion dose and anisotropic magnetic field ΔHk parallel to the magnetic garnet film with parameters of ion-implantation current.

FIG. 7 shows the relation between anisotropic magnetic field ΔHk and ion dose for a magnetized layer parallel to the magnetic garnet film prepared by implanting hydrogen ion at a large current. The anisotropic magnetic field ΔHk varies as shown at curve 5 when $H_2^+$ accelerated by 100 KeV is implanted at a beam current of 50 μA with a conventional small current ion implantation device whereas it varies as shown at curve 6 when $H^+$ accelerated by 40 KeV is implanted at a beam current of 5 mA with a large current ion implantation device. In comparison, the 5 mA beam current can reduce the implantation time by 1/20 and increasing of current upon ion implantation is very useful for practical purposes. As will be seen from FIG. 7, values of ΔHk for $H_2^+$ and $H^+$ at the same ion dose are proportioned by 2:1 which reflects a ratio between atomic numbers of $H_2^+$ and $H^+$, and a characteristic obtained with the large current implantation is fully equivalent to that obtained with the prior art ion implantation. In other words, where the ion-implanted magnetic bubble device is produced by multiple-implanting hydrogen ions alone at a large beam current, the time for ion implantation can be reduced drastically and besides, the obtainable characteristic can remain unchanged. This production method is therefore suitable for mass production of the devices.

Figure 8:
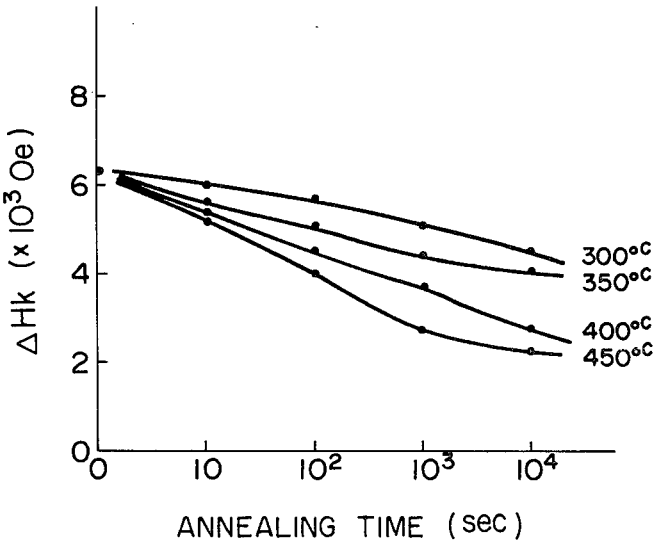
FIGS. 8 and 9 are graphs showing the relation between time for heat treatment after ion implantation and anisotropic magnetic field ΔHk parallel to the magnetic garnet film.

The anisotropic magnetic field ΔHk of a magnetized layer varies as shown in FIG. 8 when the layer is prepared by implantation with $H^+$ ion at an ion dose of $8\times10^{16}$ ion/cm$^2$ at 40 KeV and subsequent heat treatment at various temperatures. With such a relatively large ion dose of hydrogen ion as above, reduction of ΔHk due to the heat treatment is small as shown in FIG. 8. According to study of inventors of the present invention, it has been proven that an ion-implanted device prepared by multiple implantation with hydrogen ion, particularly, with $H_2^+$ at an ion dose of $2.5\times10^{16}$ ion/cm$^2$ or more and $H^+$ at an ion dose of $5\times10^{16}$ ion/cm$^2$ or more and subsequent heat treatment, for example, at 400° for 30 minutes has a satisfactory life. More particularly, when estimating the life on the basis of a life $\tau$/temperature 1/T diagram derived from FIG. 8, the ion-implanted device has a life of $10^5$ years (time for ΔHk to vary 1% at 100° C.) and practically, this device is highly reliable. In considering an upper limit of the ion dose, it has been experienced that a magnetic garnet film implanted with $H_2^+$ at an ion dose of $2\times10^{17}$ ion/cm$^2$ or more tends to become amorphous, and for this reason, the ion dose is preferably below this value.

Figure 9:
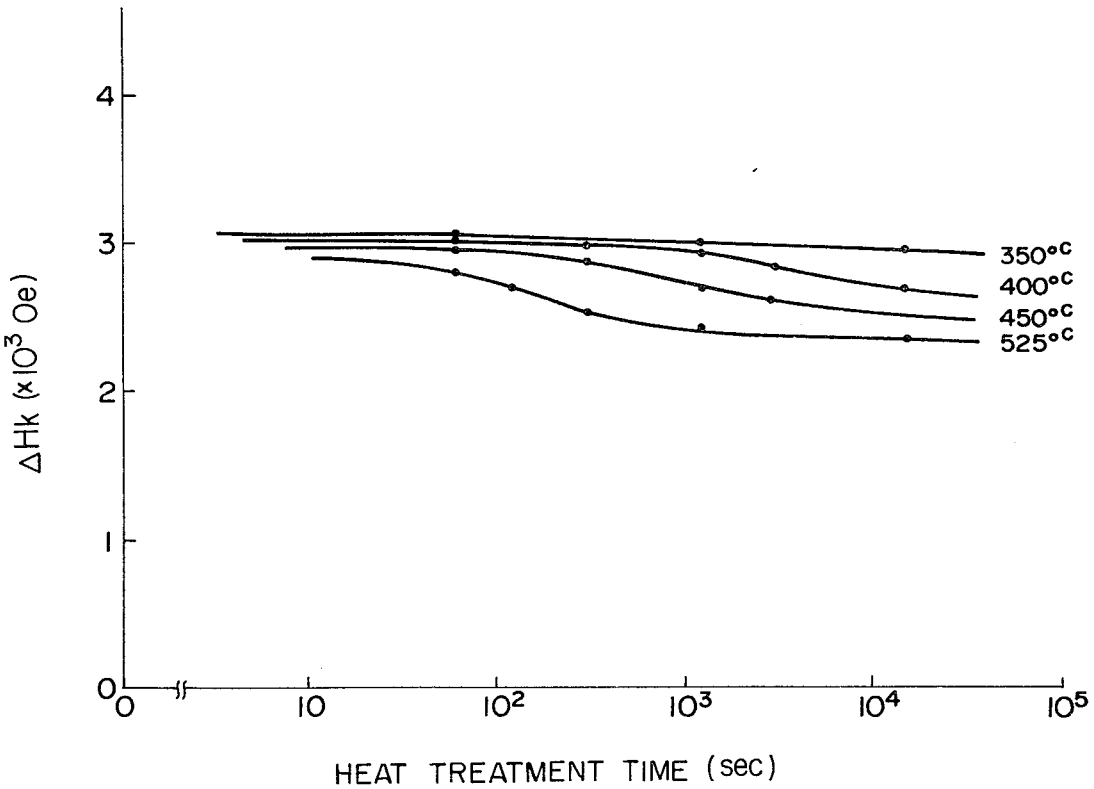
Figure 10:
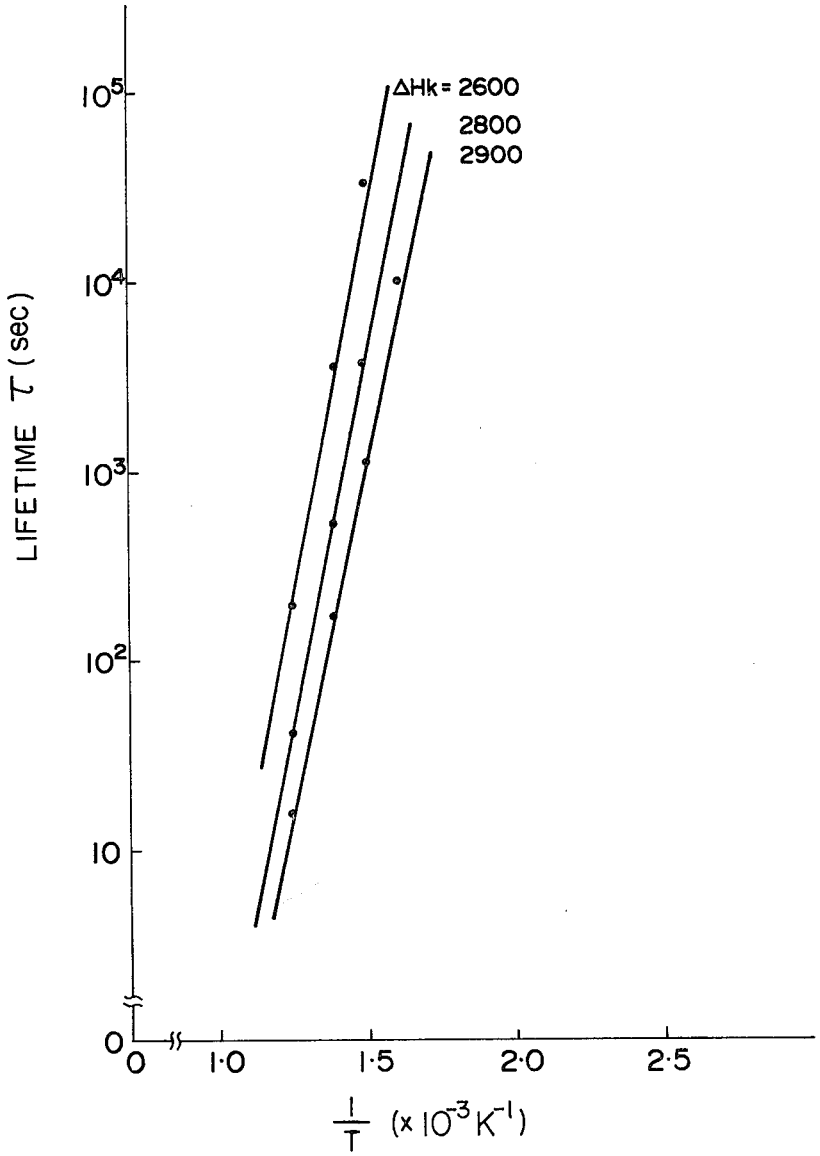
FIG. 10 is a graph showing estimation of life of the magnetic garnet film.

FIG. 9 shows the relation between anisotropic magnetic field ΔHk and heat treatment time in respect of an ion-implanted device prepared by triple implantation with hydrogen ion, particularly, with $H_2^+$ at an ion dose of $2.5\times10^{16}$ ion/cm$^2$ or more and $H^+$ at an ion dose of $5\times10^{16}$ ion/cm$^2$, and FIG. 10 shows estimated life curves derived from the results shown in FIG. 9. As will be seen from FIGS. 9 and 10, the triple implantation with $H_2^+$ at $2.5\times10^{16}$ ion/cm$^2$ or more ion dose and $H^+$ at $5\times10^{16}$ ion/cm$^2$ or more ion dose permits the employment of heat treatment at 350° C. or more, to an extreme of about 500° to 600° C., for producing an extremely stable magnetized layer in the magnetic garnet film. In addition, the thus produced device has a life of about 5000 years (time for ΔHk to vary 1% at 100° C.), exhibiting highly reliable characteristics for practical purposes.

As described above, the ion-implanted magnetic bubble memory device according to the invention produced by multiple implanting hydrogen ion has a high Curie temperature and a long life.

The stress distribution in the magnetized layer prepared by single implantation with hydrogen ion cannot be flattened, resulting in difficulties in obtaining satisfactory characteristics of the magnetized layer of the ion-implanted device.

On the other hand, the stress distribution can be flattened by multiple implantation with hydrogen ion and other ions in combination but in this case, the Curie temperature Tc is reduced as described previously, also resulting in difficulties in obtaining an ion-implanted device of excellent characteristics.

However, the multiple implantation with hydrogen ion at variant implantation voltages according to the present invention can assure the magnetized layer of the uniform stress distribution and the high Curie temperature, and the ion-implanted device with the magnetized layer can have extremely excellent characteristics.

The peak depth of the stress distribution formed by implanting hydrogen ion into the magnetic garnet film depends on acceleration voltage used for the implantation.

For example, in order to bring the peak of the concentration distribution (accordingly, the stress distribution caused thereby) to a depth of 0.3 to 0.4 μm, the acceleration voltage may be about 80 to 100 KeV.

The ion implantation depth is substantially proportional to the acceleration voltage and the depth of an ion-implanted region of the ion-implanted device is usually set to about $\frac{1}{3}$ of a thickness of the magnetic garnet film. Therefore, the maximum implantation voltage in the multiple implantation can readily be calculated from the thickness of the magnetic garnet film.

For example, where hydrogen ion is multiple-implanted into a magnetic garnet film of about 1 μm thickness, the implantations may be carried out thrice at acceleration voltages of about 80 to 100 KeV, about 50 to 65 KeV and about 25 to 30 KeV so as to obtain a uniform magnetostrictive distribution.

Obviously, as the number of multiple implantations increases, so the stress distribution becomes uniform. Practically, however, the number of implantations is about 4 to 5 at the most because the greater the number, the more complicated the process becomes. As the film thickness decreases, so the number of implantations may decrease. For example, the implantations may be carried out thrice for an about 1 μm thick film or twice for an about 0.5 μm thick film, thus producing a magnetostrictive distribution of satisfactory characteristics.

As will be clear from the foregoing description, the present invention has the following advantages:

(1) Thanks to the use of molecular gas ($H_2$ gas), the multiple implantation can be carried out readily by periodically changing analyzing current so as to obtain a flat stress distribution with a reduced peak;

(2) The Curie temperature Tc of the ion-implanted layer can be made higher than that of the prior art device prepared by implanting $Ne^+$ and $He^+$ in combination with hydrogen ion and the ion-implanted device of a wide operational temperature range can be produced;

(3) The multiple implantation with $H_2^+$ at an ion dose of $2.5\times10^{16}$ ion/cm$^2$ or more and $H^+$ at an ion dose of $5\times10^{16}$ ion/cm$^2$ or more and subsequent heat treatment can assure production of an ion-implanted device having a very long life; and (4) Since only one kind of molecular gas is used for ion implantation to form the magnetized layer parallel to the magnetic garnet film, troublesome exchange of ion sources that would be necessary for exchanging various kinds of ions for implantation can be dispensed with, thus improving mass production of the devices.

What is claimed is:

1. A method for production of a magnetic bubble memory device comprising: implanting hydrogen ion twice or more at different acceleration voltages into predetermined portions of a magnetic film, and heat treating the magnetic film having hydrogen ion implanted therein.

2. A production method according to claim 1 wherein at least one of the two or more hydrogen ion implantations is carried out at a hydrogen ion dose of about $2.5\times10^{16}$ ion/cm$^2$ or more.

3. A production method according to claim 1 wherein the hydrogen ion is implanted into a region at a depth of about $\frac{1}{3}$ of the magnetic film thickness.

4. A production method according to claim 2 wherein the hydrogen ion is implanted into a region at a depth of about $\frac{1}{3}$ of the magnetic film thickness.

5. A production method according to claim 3 wherein a maximum acceleration voltage for the ion implantation is selected such that a peak depth of a concentration distribution of the implanted ion reaches about $\frac{1}{3}$ of the magnetic film thickness.

6. A production method according to claim 4 wherein a maximum acceleration voltage for the ion implantation is selected such that a peak depth of a concentration distribution of the implanted ion reaches about $\frac{1}{3}$ of the magnetic film thickness.

7. A production method according to claim 1, wherein said hydrogen ion is $H_2^+$ and $H^+$ ions, with said $H_2^+$ ions being implanted at an ion dose of $2.5\times10^{16}$ ion/cm$^2$ or more, and said $H^+$ ions being implanted at an ion dose of $5\times10^{16}$ ion/cm$^2$ or more.

8. A production method according to claim 7, wherein the heat-treating is carried out at a temperature of at least 350° C.

9. A production method according to claim 1, wherein said hydrogen ion only is ion-implanted into said predetermined portions of a magnetic film.

10. A method for production of a magnetic bubble memory device comprising implanting only hydrogen ion twice or more at different acceleration voltages into predetermined portions of a magnetic film, whereby the Curie temperature Tc of the ion-implanted layer is high as compared with the Curie temperature Tc when implanting at least one of $Ne^+$ or $He^+$ in combination with hydrogen ion.

11. A production method according to claim 10 further comprising heat-treating an ion-implanted device.

12. A production method according to claim 11 wherein a maximum acceleration voltage for the ion implantation is selected such that a peak depth of a cencentration distribution of the implanted ion reaches about $\frac{1}{3}$ of the magnetic film thickness.

13. A production method according to claim 11, wherein at least one of the two or more hydrogen ion implantations is carried out at a hydrogen ion dose of about $2.5\times10^{16}$ ion/cm$^2$ or more, whereby an ion-implanted device having a very long life can be achieved.

* * * * *